United States Patent [19]

Thomander

[11] 4,336,412

[45] Jun. 22, 1982

[54] HEAT TREATMENT FURNACE

[75] Inventor: Ture Thomander, Hallstahammar, Sweden

[73] Assignee: Bulten-Kanthal AB, Hallstahammar, Sweden

[21] Appl. No.: 165,576

[22] Filed: Jul. 3, 1980

Related U.S. Application Data

[63] Continuation of Ser. No. 917,751, Jun. 21, 1978, abandoned.

[30] Foreign Application Priority Data

Dec. 16, 1977 [DE] Fed. Rep. of Germany ..... 2756402

[51] Int. Cl.[3] ..... F27B 5/04; F27B 9/04; H05B 3/12

[52] U.S. Cl. ..... 373/110; 373/117

[58] Field of Search ..... 13/20, 22, 25, 31; 219/388, 390

[56] References Cited

U.S. PATENT DOCUMENTS

| | | | |
|---|---|---|---|
| 3,181,845 | 5/1965 | Malm et al. | 13/22 X |
| 3,259,527 | 7/1966 | Beggs | 13/25 X |
| 3,373,239 | 3/1968 | Rubisch | 13/22 X |

OTHER PUBLICATIONS

*Mosilit* by Elektrogertebau Cesiwid GmbH, Erlangen/-Bavaria, West Germany, pub. 1959.

*Primary Examiner*—Roy N. Envall, Jr.

*Attorney, Agent, or Firm*—Pollock, Vande Sande & Priddy

[57] ABSTRACT

Electrical heating furnaces for the treatment, e.g., of steel are provided with $MoSi_2$-based resistance elements without an outer protective layer, even in the presence of a non-oxidating protective gas, for operation at about 800° to 1400° C.

5 Claims, 2 Drawing Figures

HEAT TREATMENT FURNACE

Figure 1:
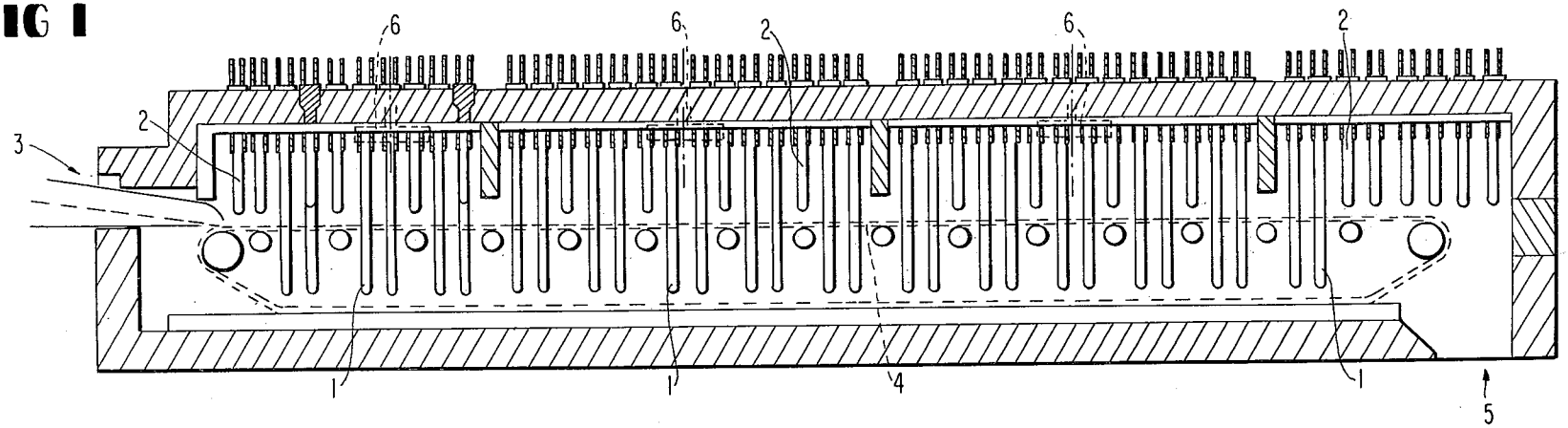

This is a continuation, of application Ser. No. 917,751, filed June 21, 1978 now abandoned.

BACKGROUND OF THE INVENTION

The present invention relates to a heat treatment furnace.

Electrically heated furnaces have several advantages over gas heated furnaces. They are environmentally perferable, since they cause less noise, lower surrounding temperatures and less pollution. Moreover, they have advantages in operation, such as less complicated temperature controls, reduced heat loss, reduced wear characteristics and more reliable energy supply.

In heat treating steel, it is frequently necessary to use a protective gas, e.g., in the case of carburetting and dry-cyaniding processes. The presence of such a protective gas, however, places great demands on the electrical heating elements. It is therefore known in the art to use as heating elements metallic, electrical resistance wires wound upon a ceramic core and normally enclosed in metallic and ceramic pipes or sheaths, whereby the heating elements are protected from the furnace atmosphere, and their useful life is extended to a commercially acceptable extent.

However, the use of protective sheaths has its disadvantages. Manufacturing and maintenance costs are high, and performance of the elements is limited to the avoidance of overheating. Heating elements of this type also have an unavoidable thermal sluggishness which causes extended heating time and difficulties in maintaining precise temperature control and distribution in the furnace.

In the case of continuous operation, the performance and temperature of the elements and their protective sheaths in the feed zone of the furnace are maximal when the steel is preheated or heated to a predetermined treatment temperature. In the case of intermittent operation, they are maximal during heating of the charge to the treatment temperature. Thus, the heating elements are exposed to particularly great stresses in the said feed zone and/or heating period.

SUMMARY OF THE INVENTION

It is an object of the present invention to provide an electrical furnace of the type described enabling rapid heating to the desired operating temperature, precise temperature control, great efficiency, even temperature distribution in the furnace chamber and improved durability of the heating elements. As a result, production costs, including operating and maintenance costs, are lowered.

While electrical resistance elements consisting mainly of molydenum disilicide have been used in the past, they were generally provided with an automatically formed protective layer of silicon dioxide glass, and are used at very high temperatures, e.g., at 1300° to 1800° C., and in an atmosphere which is oxidizing with respect to the elements. These known resistance elements, sold under the trademark KANTHAL SUPER, are able to operate at the stated high temperatures because the protective layer, if damaged for some reason, will form anew in an oxidizing atmosphere since the silicon containing basic material automatically forms a new outer layer having the same properties as the original layer.

However, this facility for self-regeneration, which is the basis for the good performance of the known KANTHAL SUPER elements, presupposes an oxidizing atmosphere.

It has, however, surprisingly been shown that the elements based on molybdenum disilicide can be used advantageously even in the presence of a non-oxidizing protective gas, although at low temperatures, i.e., in precisely the temperature range (ca. 800° to 1400° C., especially 900° to 1300° C.) required for the heat treatment of steel in a protective gas. In this connection, the elements operate without a protective quartz glass layer on their surfaces, and surprisingly have proved to be usable even after five years without protective layer.

In the furnace according to the invention, the $MoSi_2$-based resistance elements have several advantages. The omission of special protective sheaths, which have a useful life of three years at most, facilitates faster heating of the furnace, since the resistance elements radiate heat directly into the furnace chamber, thereby shortening the entire heat treatment period and augmenting productivity. Furthermore, precise temperature control, high efficiency and even temperature distribution are obtained, whereby the quality of the products of heat treatment can be maintained at a constant and high level.

The furnace can be arranged for continuous or intermittent operation. In the case of intermittent operation, there is the particular advantage that the $MoSi_2$-based resistance elements assure a short heating period because their specific resistance rises with the temperature, their performance level rising automatically during cooling because of then decreasing resistance. This phenomenon, known per se, is also significant in the case of continuously operating furnaces, in which the elements are cooled in the feed zone by material being fed thereinto.

According to preference, the furnace can be provided with substantially vertically or horizontally mounted elements, which can, for example, be carried by heat-retaining carriers.

BRIEF INTRODUCTION TO THE DRAWINGS

Figure 2:
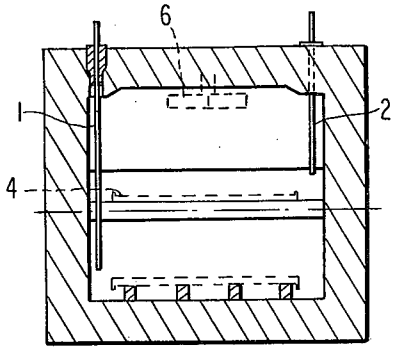

FIGS. 1 and 2 show longitudinal and transverse sections, respectively, of a continuous furnace for the hardening of bolts.

PREFERRED EMBODIMENTS OF THE INVENTION

Three examples of furnaces according to the invention will now be described. Each has been tested in continuous trials and embodies the advantages described above.

EXAMPLE 1

Two electrically heated furnaces were used for hardening bolts by carbon-nitriding at 900° C. These furnaces were provided with $MoSi_2$-based resistance elements. The temperature of the elements in operation was about 1300° C.

One of the furnaces was placed in operation in 1970. The entire consumption of elements comprised only one set of elements (10 pieces). Such breakage of elements as occurred was entirely due to carelessness during mechanical furnace operation. In the other furnace, which was placed in operation in 1975, only one instance of element breakage has occurred up to the present. The elements work freely in the protective atmosphere, which comprises 3% $NH_3$, 5% propane, and the rest Endogas.

The furnace capacity has turned out to be significantly higher than before use of the elements according to the present invention, despite nominally equal performance. However, burning off of soot was necessary about once every two weeks, as with conventional elements.

EXAMPLE 2

FIGS. 1 and 2 illustrate a continuous furnace intended for the hardening of bolts, wherein 106 $MoSi_2$-based resistance elements 1 and 2 were hung without protective pipes. The total performance equaled 700 kW, and the production capacity was about 50% higher than in furnaces provided with metallic elements with protective pipes.

Bolts sized up to 1½" were hardened in this furnace, which was about 10 m long and 2.25 m high. The bolts were fed into an inlet 3 and were transported through the furnace on a link belt conveyor 4. They were then discharged through an outlet 5. The furnace operated about seven months with the new elements, and only three breakages occurred during this time, all due to mechanical damage.

The protective atmosphere in this case comprised mainly endogas and propane.

In operation, the furnace temperature was about 900° C., and that of the elements about 1300° C. The heat distribution in the furnace was kept uniform by means of roof fans 6.

EXAMPLE 3

In a rebuilt electric carburizing furnace provided with $MoSi_2$-based resistance elements, the following was observed:

When the gas heated radiation pipes were replaced by elements according to the present invention, a 40% increase in production capacity, from 3.5 to 5 productive units per day, could be observed in the furnace. This result was attained without any changes in the dimensions of the furnace, and was principally attributable to the substantially shorter time required for reheating the furnace after charging. By means of the new elements, this reheating period was reduced from 3.5 hours to 1.25 hours, i.e., by 64%.

Apart from its technical and economical advantages, electrical operation has considerable advantages from an environmental point of view, e.g., reduced noise level, cleaner surrounding air and cleaner working conditions.

When gas heated furnaces were used, a performance level of 80 kW was reached. Insertion of 12 $MoSi_2$-based elements raised this to 114 kW.

The furnace temperature during carburizing amounted to 930° C., and the atmosphere was an endogas produced through cracking of natural gas, comprising approximately 39% $H_2$, 21% CO, 0.4% $CH_4$, 0.1% $CO_2$ and 39% $N_2$, with a condensation point of 12° to 18° C. Natural gas was added to increase the carbon content.

The recommended surface load of the elements amounted to about 18.5 W/cm$^2$, corresponding to 9.5 kW per element. In the installation, four elements were connected in series, and each element was loaded with maximally 30 V.

The elements were installed without protective pipes, so that the energy radiated directly from each element into the furnace.

The following table lists the time required for a carburizing cycle, on the one hand with gas heating, on the other hand with heating by means of the elements according to the present invention:

| | gas heated | $MoSi_2$-based resistance elements |
|---|---|---|
| Loading | 5 minutes | 5 minutes |
| Heating period | 3.5 hours | 1.25 hours |
| Cooling | 0.75 hours | 1.5 hours (due to improved insulation in the furnace) |
| Holding period | 1.5 hours | 1.5 hours |
| Evacuation | 5 minutes | 5 minutes |
| Total | 5 hours, 55 minutes | 4 hours, 25 minutes |

What is claimed is:

1. Heat treatment furnace comprising (a) a housing having a feed zone therein;

(b) a plurality of electrical heating elements at least some of which are positioned in said feed zone;

(c) means for introducing into said furnace a nonoxidizing atmosphere at maximally about 1050° C.;

(d) at least those heating elements which are positioned in said feed zone comprising electrical resistance elements of substantially poreless material principally comprising molybdenum disilicide; and (e) said resistance elements being free of any protective coating in order to place them in unobstructed contact with said non-oxidizing atmosphere.

2. Heat treatment furnace according to claim 1, wherein said resistance elements are so arranged and dimensioned that they have a temperature during heat treatment of 800° to 1400° C.

3. Heat treatment furnace according to claim 2, wherein said resistance elements have a temperature during heat treatment of 900° and 1300° C.

4. Heat treatment furnace according to any one of claim 2, 3 or 1, wherein the atmosphere of said furnace is carburizing.

5. Heat treatment furnace according to any one of claim 2, 3 or 1, wherein the atmosphere of said furnace is carbo-nitriding.

* * * * *